US005615599A

United States Patent [19]

Terauchi

[11] Patent Number: 5,615,599

[45] Date of Patent: Apr. 1, 1997

[54] GUIDING MECHANISM FOR RECIPROCATING PISTON OF PISTON-TYPE COMPRESSOR

[75] Inventor: Kiyoshi Terauchi, Isesaki, Japan

[73] Assignee: Sanden Corporation, Gunma, Japan

[21] Appl. No.: 516,863

[22] Filed: Aug. 18, 1995

[30] Foreign Application Priority Data

Aug. 23, 1994 [JP] Japan ..... 6-222412

[51] Int. Cl.[6] ..... F16J 15/18

[52] U.S. Cl. ..... 92/165 R; 92/165 PR; 92/71; 417/269; 74/60

[58] Field of Search ..... 92/71, 12.2, 165 R, 92/165 PR; 417/269; 74/60

[56] References Cited

U.S. PATENT DOCUMENTS 1,781,068 11/1930 Mitchell .
3,939,717 2/1976 Teisen ..... 74/60
4,448,154 5/1984 Kossel ..... 123/55 BB
4,495,855 1/1985 Murakami ..... 92/71
5,382,139 1/1995 Kawaguchi et al. .

*Primary Examiner*—Thomas E. Denion
*Attorney, Agent, or Firm*—Baker & Botts, L.L.P.

[57] ABSTRACT

A piston-type compressor has a compressor housing enclosing a crank chamber, suction chamber, and a discharge chamber. The compressor housing also includes a cylinder block having at least two cylinders. A single head-type piston is slidably disposed within each of the cylinders. A drive shaft is rotatably supported in the cylinder block. A plate is tiltably connected to the drive shaft. A bearing couples the plate to the pistons, so that the pistons are driven in a reciprocating motion within the cylinders upon rotation of the plate. A piston guiding mechanism has a first guiding device which is formed on the peripheral of the piston, and a second guiding device which is disposed within the housing for guiding the first guiding device to slide smoothly along the second guiding device and to prevent the piston from rotating around its axis or radially inclining when the piston reciprocates in the cylinder. Thus, the movement of a piston during reciprocating is carefully regulated, and the durability of the compressor increases.

15 Claims, 8 Drawing Sheets

GUIDING MECHANISM FOR RECIPROCATING PISTON OF PISTON-TYPE COMPRESSOR

BACKGROUND OF THE INVENTION

1. Field of the Invention

The present invention relates to a piston-type compressor, in which fluid may be compressed by means of reciprocating pistons connected to a swash plate. More particularly, it relates to a guiding mechanism for reciprocating pistons, which improves control of the position of the pistons in the refrigerant compressor for an automotive air-conditioning system.

2. Description of the Prior Art

A swash plate refrigerant compressor with a variable displacement mechanism, particularly, a single head piston-type compressor suitable for use in an automotive air condition system, is disclosed in U.S. Pat. No. 4,664,604, which disclosure is incorporated herein by reference. Referring to FIGS. 1, 2, and 3, a cylinder block is accommodated in cylindrical housing 211 of a compressor. Pistons 48 are accommodated in cylinders 127 and are reciprocally movable therein. Drive shaft 115, which is driven by an engine, is rotatably supported by means of the central portion of the cylinder block and a front cover. Rotor plate 118 is mounted on drive shaft 115 and synchronously rotates with drive shaft 115. Further, swash plate 124 is tiltably mounted on drive shaft 115 and is reciprocally slidable together with spherical sleeve 129 parallel to the axis of drive shaft 115. Rotor plate 118 and swash plate 124 are connected to each other by means of a hinge mechanism. Swash plate 124 is engaged along its circumference with the interior portion of the associated piston(s) 48.

According to the above-described compressor, when drive shaft 115 is rotated, rotor plate 118 rotates together with drive shaft 115. The rotation of rotor plate 118 is transferred to swash plate 124 through the hinge mechanism. Rotor plate 118 is rotated with a surface inclined with respect to drive shaft 115, so that pistons 48 reciprocate in cylinder 127, respectively. Therefore, refrigerant gas is drawn into an inlet chamber and compressed and discharged from the inlet chamber into an associated discharge chamber, respectively.

Control of displacement of this compressor may be achieved by varying the stroke of piston 48. The stroke of piston 48 varies depending on the difference between pressures which are acting on the opposing sides of swash plate 124. This difference is created by variance between the pressure in a crank chamber acting on the rear surface 48*a* of piston 48 and suction pressure in cylinder 127 acting on the front surface 48*b* of piston 48, and acts on swash plate 124, through piston 48.

Cylinder housing 211 includes projection portion(s) 212 extending therefrom toward the interior of housing 211 and parallel to the reciprocating direction of piston(s) 48 for preventing the rotation of piston(s) 48 around its axis (their axes). In this arrangement, the frictional force between swash plate 124 and spherical sleeves 129 is generated because swash plate 124 slides in spherical sleeves 129 while rotating. Thereby, the frictional force acts on piston 48 to forcibly move them in the direction of the inner surface of cylinder 127 and urging them to rotate around the axis of piston 48.

Further, the inner surface of cylinder 127 functions to prevent piston 48 from inclining in a radial direction except for its rotation. However, it is difficult for cylinder 127 to prevent piston 48 from inclining in a radial direction when piston 48 approaches a bottom dead center position because the area of contact between piston 48 and cylinder 127 relative to the length of the piston within the cylinder decreases in comparison with that of existing near a top dead center position of piston 48, though cylinder 127 may prevent piston 48 from inclining in a radial direction when piston 48 approaches a top dead center position.

Therefore, in existing designs, pistons 48 experience rapid wear on their peripheral surfaces. As a result, compressor durability is reduced and noise and vibration of the compressor increase.

SUMMARY OF THE INVENTION

It is an object of the invention to provide a piston-type compressor, in which the movement of a piston during reciprocation is precisely regulated by a piston guiding mechanism.

It is another object of the present invention to provide a piston-type compressor which has a superior durability. Further, such a compressor may generate less noise and vibration during operation.

According to the present invention, a compressor comprises a compressor housing including a crank chamber, suction chamber, a discharge chamber, and a cylinder block. A plurality of cylinders are formed in the cylinder block. The compressor further comprises a plurality of pistons, e.g., single head-type pistons. Each of the pistons has an end and an axis and is slidably disposed within one of the cylinders. A drive shaft is rotatably supported in the cylinder block. A plate is tiltably connected to the drive shaft. A bearing couples the plate to the pistons, so that the pistons may be driven in a reciprocating motion within the cylinders upon rotation of the plate. At least one working chamber is defined by an end of each of the pistons and an inner surface of each of the cylinders. A support portion is disposed coaxially with the drive shaft and tiltably supports a central portion of the plate. A piston guiding mechanism includes at least one first guide formed on a peripheral surface of the piston, and at least one second guide disposed within the housing for guiding the at least one first guide to slide smoothly along the at least one second guide and to prevent the piston from rotating around axis thereof or radially inclining as the piston reciprocates within the cylinders.

Other objects, features, and advantages will be understood when the following detailed description of embodiments of the invention and accompanying drawings are considered.

DESCRIPTION OF PREFERRED EMBODIMENTS

Figure 1:
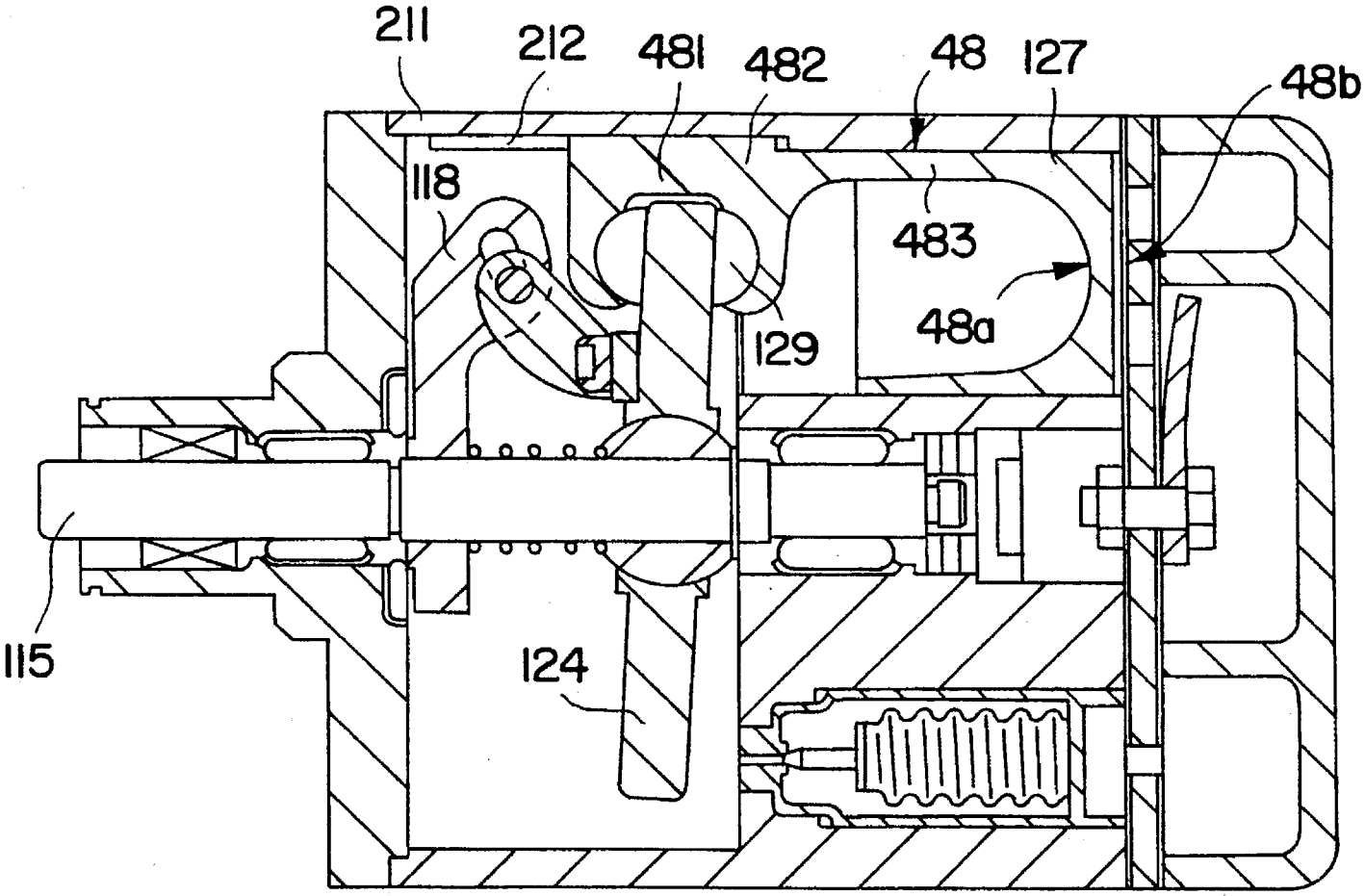
FIG. 1 PRIOR ART
FIG. 1 is a longitudinal cross-sectional view of a swash plate refrigerant compressor with a variable displacement mechanism in accordance with a prior art.
Figure 2:
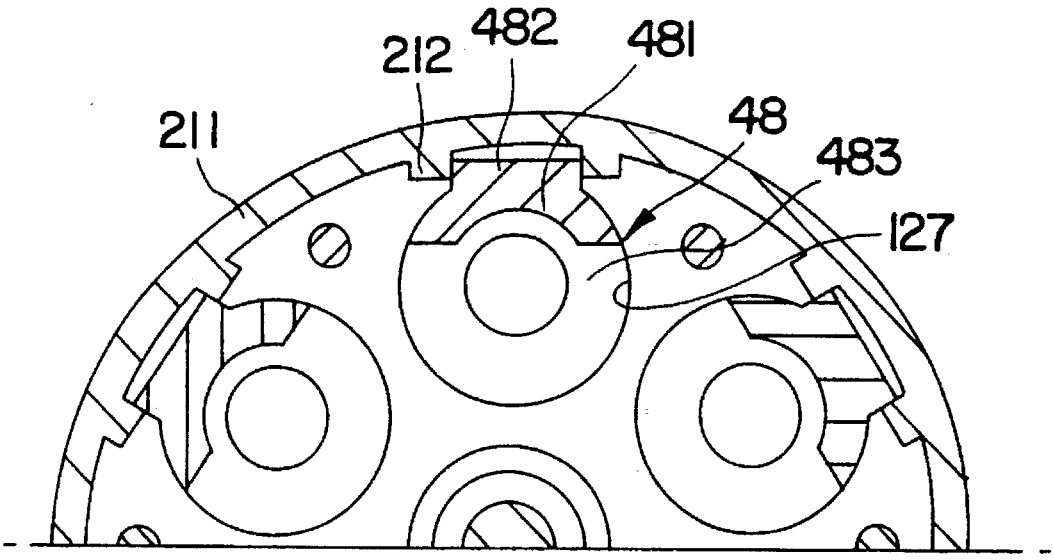
FIG. 2 PRIOR ART
FIG. 2 is a cross-sectional view taken along line 2—2 of FIG. 1 in accordance with one embodiment of the prior art.
Figure 3:
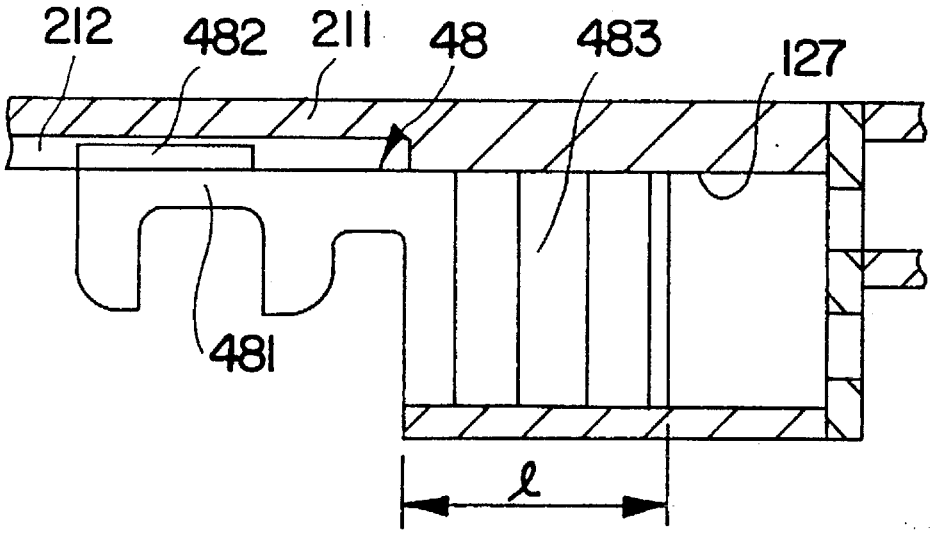
FIG. 3 PRIOR ART
FIG. 3 depicts a guiding mechanism of pistons in accordance with the prior art.
Figure 4:
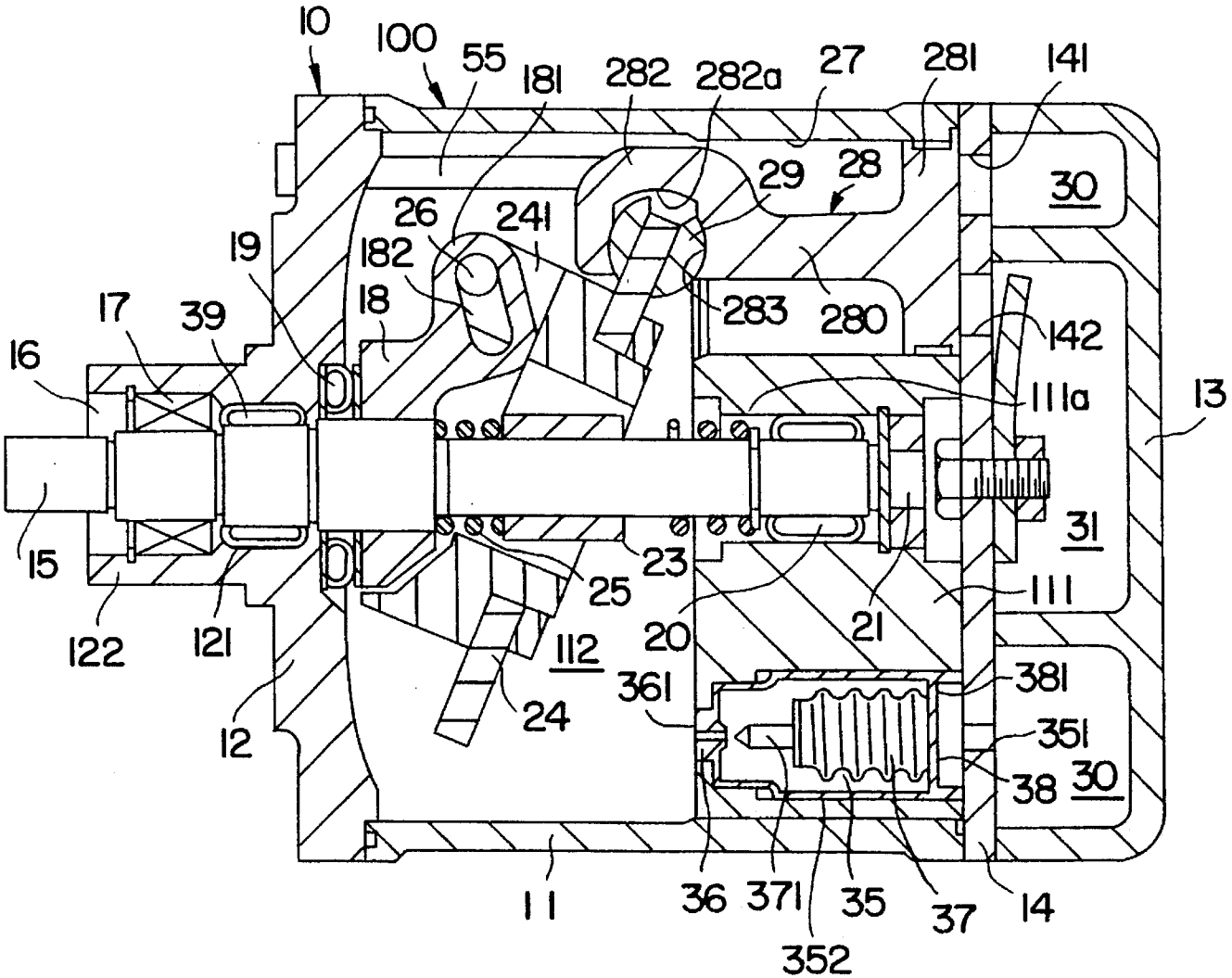
FIG. 4 is a longitudinal cross-sectional view of a swash plate refrigerant compressor with a variable displacement mechanism in accordance with the present invention.

Referring to FIG. 4, a refrigerant compressor according to this invention is shown. The compressor, which is generally designated by reference number 100, includes closed cylinder housing assembly 10 formed by annular casing 11 provided with cylinder block 111 at one of its ends, a hollow portion such as crank chamber 112, front end plate 12, and rear end plate 13. Thrust needle bearing 19 is placed between the inner end surface of front end plate 12 and the adjacent axial end surface of rotor plate 18 to receive the thrust load that acts against rotor plate 18 and, thereby, to ensure smooth operation.

The outer end of drive shaft 15, which extends outwardly from sleeve 122, is driven by an engine or motor of a vehicle through a conventional pulley arrangement (not shown). The inner end of drive shaft 15 extends into central bore 111*a* formed in the center portion of cylinder block 111 and is rotatably supported therein by a bearing, such as radial needle bearing 20. The axial position of drive shaft 15 may be changed by means of adjusting screw 21 which is screwed into a threaded portion of center bore 111*a*.

Spherical bush 23, which is placed between rotor plate 18 and the inner end of cylinder block 111, is slidably carried on drive shaft 15. Spherical bush 23 supports a slant or swash plate 24 for both nutational (e.g., wobbling) and rotational motion. Coil spring 25 surrounds drive shaft 15 and is placed between the end surface of rotor plate 18 and one axial end surface of bush 23 to urge spherical bush 23 toward cylinder block 111. Swash plate 24 is connected with rotor plate 18 through a hinge coupling mechanism for rotation in unison with rotor plate 18. More particularly, rotor plate 18 has arm portion 181 projecting axially inwardly from one side surface of rotor plate 18, and swash plate 24 has arm portion 241 projecting toward arm portion 181 of rotor plate 18 from one side surface of swash plate 24. Arm portions 181 and 241 overlap and are connected to one another by pin 26 which extends into an oblong or rectangular hole 182 formed through arm portion 181 of rotor plate 18. In this manner, rotor plate 18 and swash plate 24 are hinged to one another. In this construction, pin 26 is slidably disposed in hole 182, which causes the slant angle of the inclined surface of swash plate 24 to change.

Rear end plate 13 is shaped to define suction chamber 30 and discharge chamber 31. Valve plate member 14, which together with rear end plate 13 is fastened to the end of cylinder block 111 by screws, is provided with a plurality of valved suction ports 141 joining suction chamber 30 and respective cylinders 27.

Further, crank chamber 112 and suction chamber 30 are connected by passageway 35 which comprises aperture 351 formed through valve plate 14 and gaskets (not shown) and bore 352 formed in cylinder block 111. Coupling element 36 with small aperture 361 is disposed in the end opening of bore 352, which faces crank chamber 112, and bellows element 37 containing gas and having needle valve 371 also is disposed in bore 352. The opening and closing of small aperture 361, which is connected between crank chamber 112 and bore 35, is controlled by needle valve 371, and the axial position of bellows element 37 is determined by frame element 38 disposed in bore 352. At least one hole 381 is formed through frame 38 to permit communication between aperture 351 and bore 352.

Cylinder block 111 has a plurality of annularly arranged cylinders 27 into which pistons 28 slide. For example, cylinder block 111 may include five cylinders 27, but a smaller or larger number of cylinders may be provided. Each of single head-type piston 28 may comprise head portion 281 slidably disposed within cylinder 27, arm portion 280 axially extending from the center of head portion 281, and connection portion 282. Connection portion 282 of pistons 28 has cutout portion 282*a* which straddles the outer peripheral portion of swash plate 24. Semi-spherical thrust bearing shoes 29 are disposed between each side surface of swash plate 24 and face the inner surface of connection portion 282 to facilitate sliding contact along the side surface of swash plate 24.

In operation, drive shaft 15 may be rotated by an engine or motor of a vehicle through the pulley arrangement, and thus, rotor plate 18 is rotated together with drive shaft 15. Such rotation of rotor plate 18 is transferred to swash plate 24 through the hinge coupling mechanism, so that with respect to the rotation of rotor plate 18 shown in FIG. 4, the inclined surface of swash plate 24 moves axially to the right and left. Pistons 28, which are operatively connected to swash plate 24 by means of swash plate 24, slide between bearing shoes 29 and, therefore, reciprocate within cylinders 27. As pistons 28 reciprocate, refrigerant gas, which is introduced into suction chamber 30 from a fluid inlet port (not shown), is taken into each cylinder 27 through valved suction ports 141 and compressed. The compressed refrigerant gas vents to discharge chamber 31 from each cylinder 27 through discharge port 142 and therefrom into an external fluid circuit (not shown), e.g., a cooling circuit, through the fluid outlet port (not shown).

When the heat load of the refrigerant gas exceeds a predetermined level, the suction pressure is increased. For example, such a predetermined level may relate to the level set at or measured by a thermostat located in a compartment of a vehicle, which controls the temperature existing at a beginning stage or a stage from which the temperature is lowered by the operation of the compressor to a desired temperature. Therefore, in this case, the pressure of the gas contained in bellows element 37 is set at about the same level as the pressure for the predetermined heat load level, and, referring again to FIG. 4, bellows element 37 is urged toward the right side to open aperture 361. Thus, the pressure in crank chamber 112 is maintained at the suction pressure. In this condition, during the compression stroke of pistons 28, reaction force of gas compression normally acts against swash plate 24 and is finally transferred to the hinge coupling mechanism.

On the other hand, if the heat load is decreased and the refrigerant capacity is exceeded, the pressure in suction chamber 30 is decreased, referring to FIG. 4, bellows element 37 moves to the left side to close small aperture 361 with needle valve 371. In this case, the pressure in the crank chamber 112 is gradually raised, and a narrow pressure difference occurs due to blow-by gas, which leaks from the working chamber to crank chamber 112 during the compression stroke through a gap between piston 28 and cylinder 27, is contained in crank chamber 112.

Figure 5:
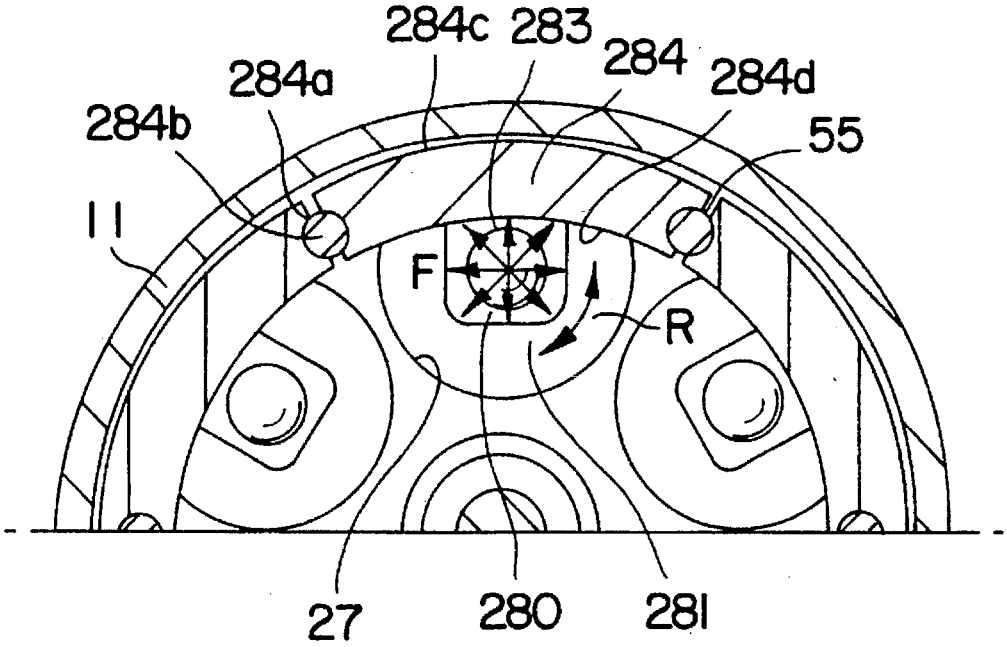
FIG. 5 is a cross-sectional view taken along line 5—5 of FIG. 4 in accordance with a first embodiment of the present invention.
Figure 6:
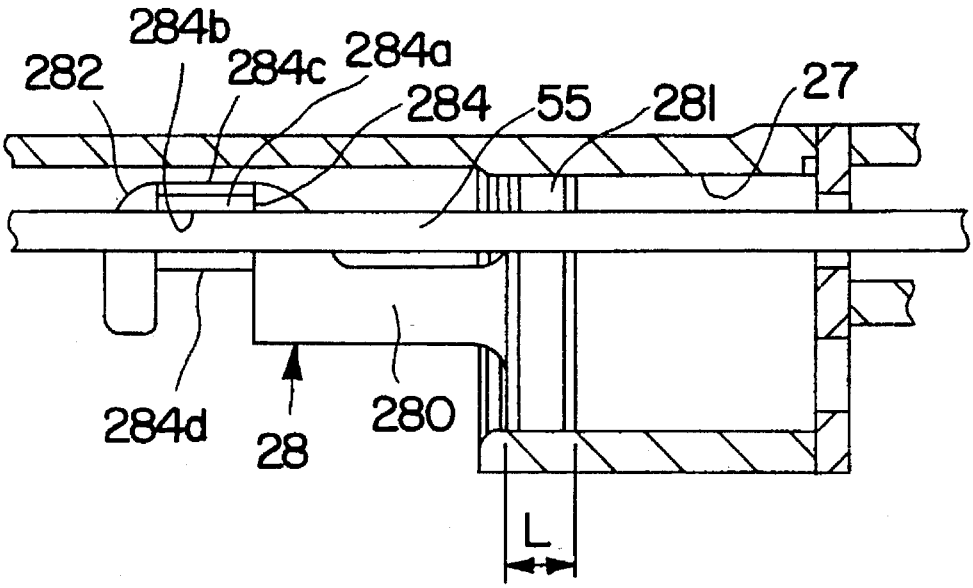
FIG. 6 depicts a guiding mechanism of pistons in accordance with the first embodiment of the present invention.

Referring to FIGS. 5 and 6, connection portion 282 includes a pair of projections 284 extending radially from the peripheral surface of piston 28. Each projection 284 includes surface portion 284*a* formed on the radial end thereof, and groove 284*b* is formed substantially on the center of surface portion 284*a*. Further, projection 284 includes curved surface 284*c* formed on the radial exterior portion of piston 28, and curved surface 284*d* is formed on the radial interior portion of piston 28, which are also curved with respect to the inner surface of cylinder housing 11. Each groove 284*b* extends along and is parallel to the longitudinal axis of housing bolts 55, which penetrate through the adjacent cylinders 27. Groove 284*b* has a half circular shape in radial cross-section. Groove 284*b* of projection 284 slidably receives housing bolts 55, so that piston 28 is prevented from rotating around the axis thereof and from inclining toward all radial direction.

The frictional force between swash plate 24 and shoes 29, which is generated by the sliding of swash plate 24 within shoes 29, is transferred to piston 28 and urges piston 28 to rotate around its axis and to incline in radial directions. However, the fit between groove 284*b* and housing bolts 55 opposes the action of the above-mentioned rotation force R and radial forces F, as shown in FIG. 5. Therefore, the guiding mechanism prevents piston 28 from inclining in a radial direction of the compressor without requiring contact in addition to that between head portion 281 of piston 28 and cylinder 27. Thereby, wear on the peripheral surface of piston 28 may be reduced. Further, length L of piston head 281 may be shorter than that of prior art embodiments. As a result, the depth of cylinder 27 may also be designed to be shorter than that of prior art embodiments without a loss of compressor capacity. Thus, the radial length of the compressor may be reduced in order to obtain a more compact compressor.

Figure 7:
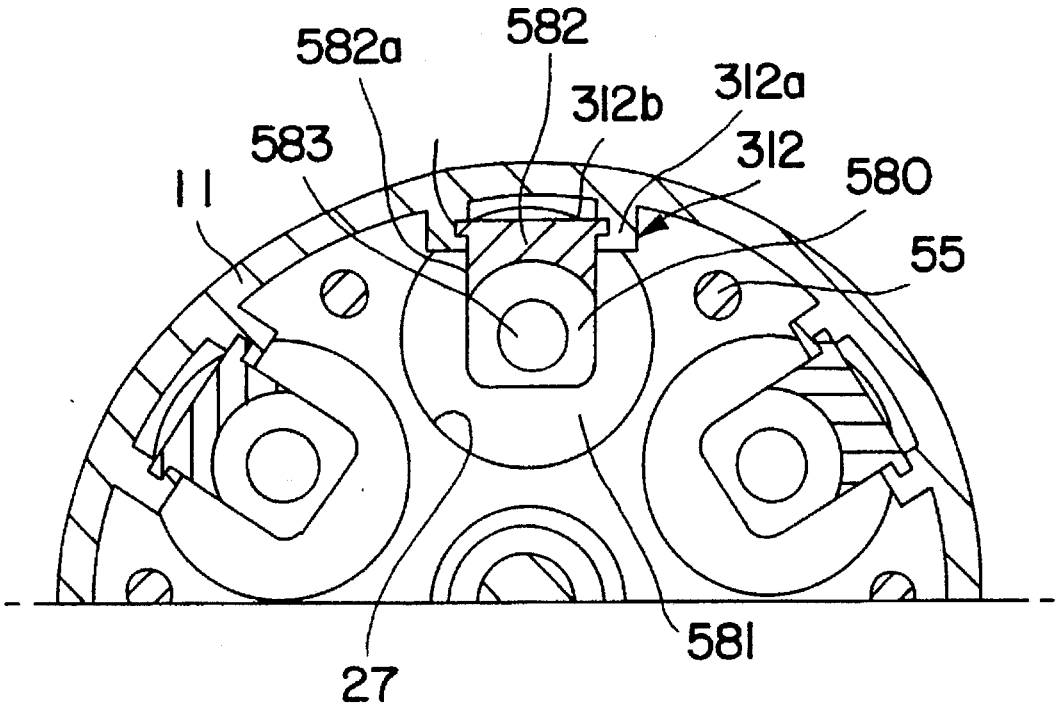
FIG. 7 is a cross-sectional view taken along line 5—5 of FIG. 4 in accordance with a second embodiment of the present invention.
Figure 8:
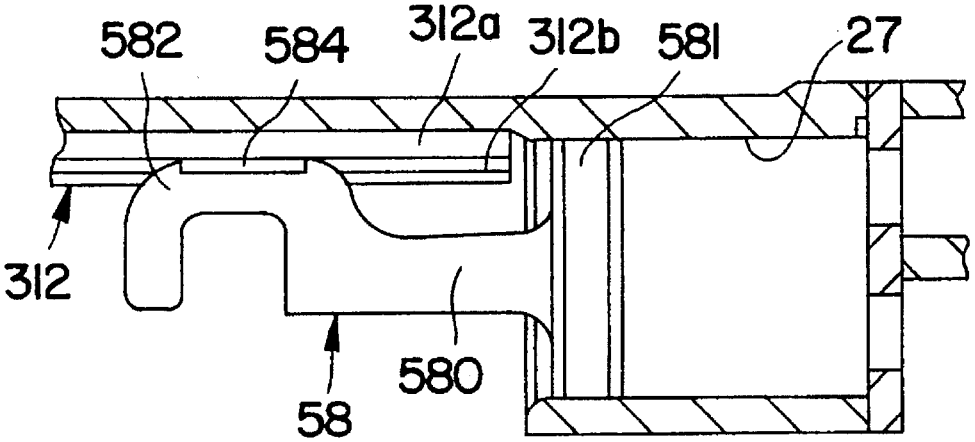
FIG. 8 depicts a guiding mechanism of pistons in accordance with the second embodiment of the present invention.

FIGS. 7 and 8 illustrate a second embodiment of the present invention, which possesses structures and features similar to those of the first embodiment, with the exception of at least the following structures. Connection portion 582 includes a pair of surface portions 582*a* formed radially on both sides thereof, and a pair of projection portions 582*b* extending perpendicularly from surface portions 582*a*. Further, each of projection portion 582*b* is designed to be parallel to the longitudinal axis of piston 58. Each of projection portion 582*b* has a substantially rectangular shaped radial cross-section. Moreover, cylinder housing 11 includes a plurality of integral arms 312 extending from its inner surface toward the interior of cylinder housing 11. A pair of arms 312 are designed to be positioned corresponding to each piston 58 and are positioned at a separation which is larger than the radial width of connection portion 582. Each arm 312 includes arm portion 312*a* and groove 312*b* formed corresponding to projection portion 582*b* of piston 58. Each groove 312*b* has a substantially rectangular shaped radial cross-section. Therefore, each piston 58 is bracketed with a pair of arms 312 of housing 11, so that a pair of projection portions 582*b* inserts and smoothly slide in grooves 312*b*.

Figure 9:
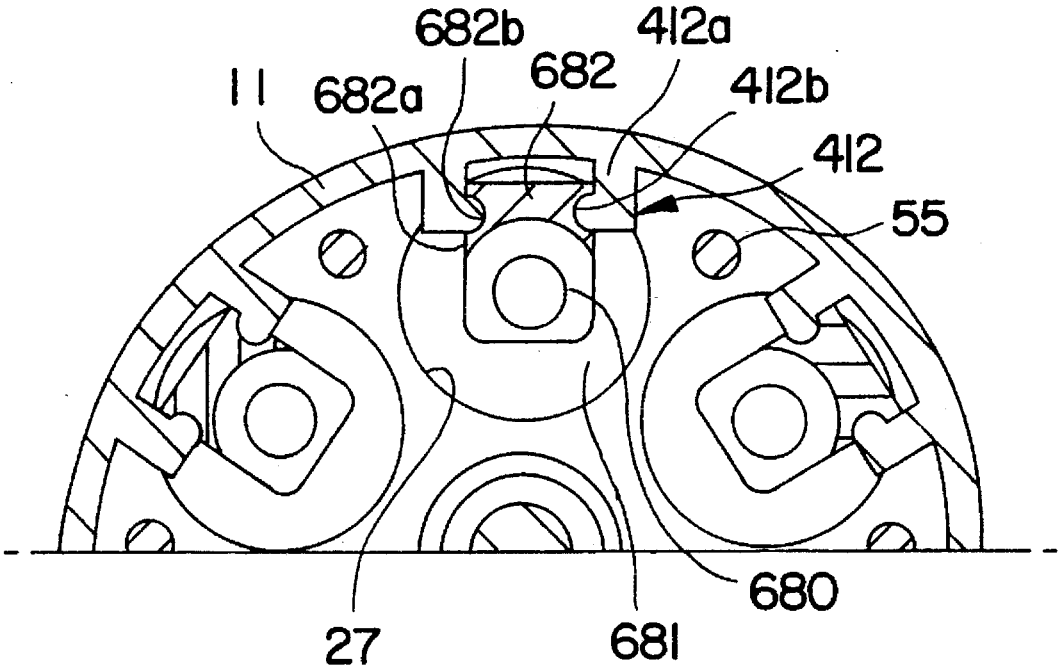
FIG. 9 is a cross-sectional view taken along line 5—5 of FIG. 4 in accordance with a third embodiment of the present invention.
Figure 10:
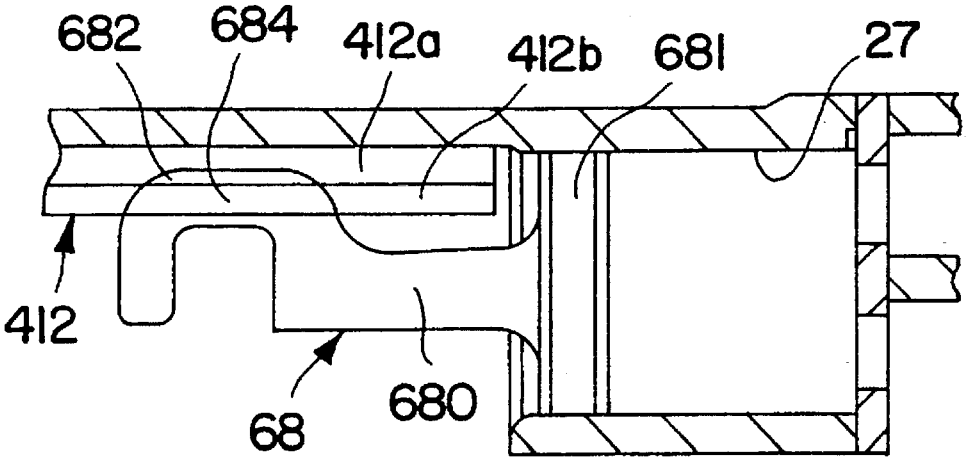
FIG. 10 depicts a guiding mechanism of pistons in accordance with the third embodiment of the present invention.

FIGS. 9 and 10 illustrate a third embodiment of the present invention, which possesses structures and features similar to those of the first embodiment, with the exception of at least the following structures. Connection portion 682 includes a pair of surface portions 682*a* formed radially on both sides thereof, and a pair of grooves 682*b* extending directly from surface portion 582*a*. Further, each groove 682*b* extends along and is substantially parallel to the longitudinal axis of piston 58. Each groove 682*b* also has a substantially rectangular shaped radial cross-section. Moreover, cylinder housing 11 includes a plurality of integral arms 412 extending from its inner surface toward the interior of cylinder housing 11. A pair of arms 412 are designed to be positioned corresponding to each piston 68 and are positioned at a separation which is larger than the radial width of connection portion 682. Each arm 412 includes arm portion 412*a* and projection 412*b* formed to correspond to groove 682*b* of piston 68. Each projection 412*b* has a substantially rectangular shaped radial cross-section. Therefore, each piston 68 is bracketed with a pair of arms 412 of housing 11, so that a pair of projections 412*b* inserts and smoothly slide in grooves 682*b*.

Figure 11:
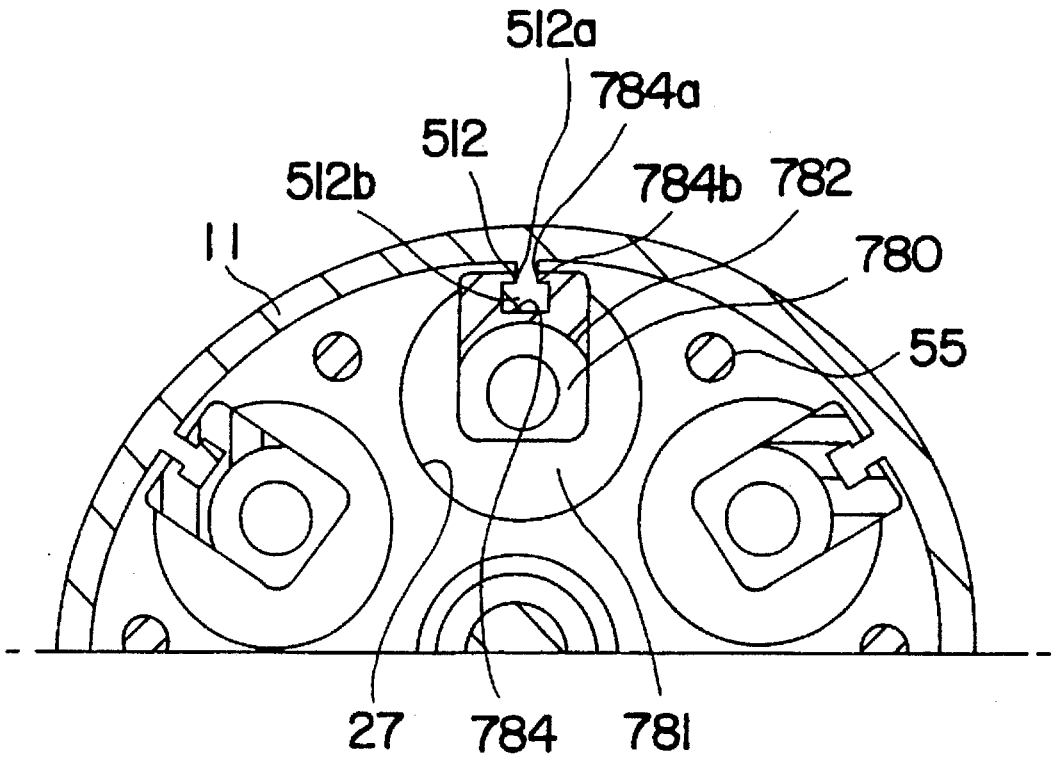
FIG. 11 is a cross-sectional view taken along line 5—5 of FIG. 4 in accordance with a fourth embodiment of the present invention.
Figure 12:
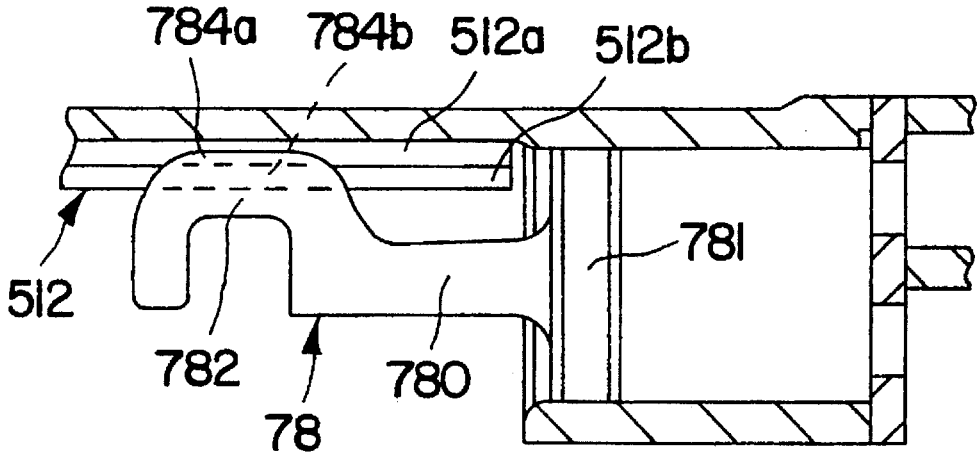
FIG. 12 depicts a guiding mechanism of pistons in accordance with the fourth embodiment of the present invention.

FIGS. 11 and 12 illustrate a fourth embodiment of the present invention, which possesses structures and features similar to those of the first embodiment, with the exception of at least the following structures. Connection portion 782 includes groove 784 formed in the interior of portion 782 and extending along the longitudinal axis of piston 78. Groove 784 has a rail-like shaped radial cross-section. More particularly, groove 784 may include first groove portion 784*a* and second groove portion 784*b*. Second groove portion 784*b* may be designed to be deeper within the interior of portion 782 than first groove portion 784*a*. The width of second groove portion 784*b* may also be designed to be larger than that of first groove portion 784*a* in radial cross-section. Further, cylinder housing 11 may include arm 512 extending from inner surface toward the center of cylinder 27 and along the longitudinal axis of piston 78. Arm 512 may include first arm portion 512*a* and second arm portion 512*b* extending from first projection portion 512*a*. Arm portion 512 also has a rail-like shaped radial cross-section. More particularly, the width of second arm portion 512*b* may be larger than first arm portion 512*a* in radial cross-section. Further, each piston 78 is connected with arm 512*a* of housing 11, so that arm 512 smoothly slides within groove 784 of piston 78.

Figure 13:
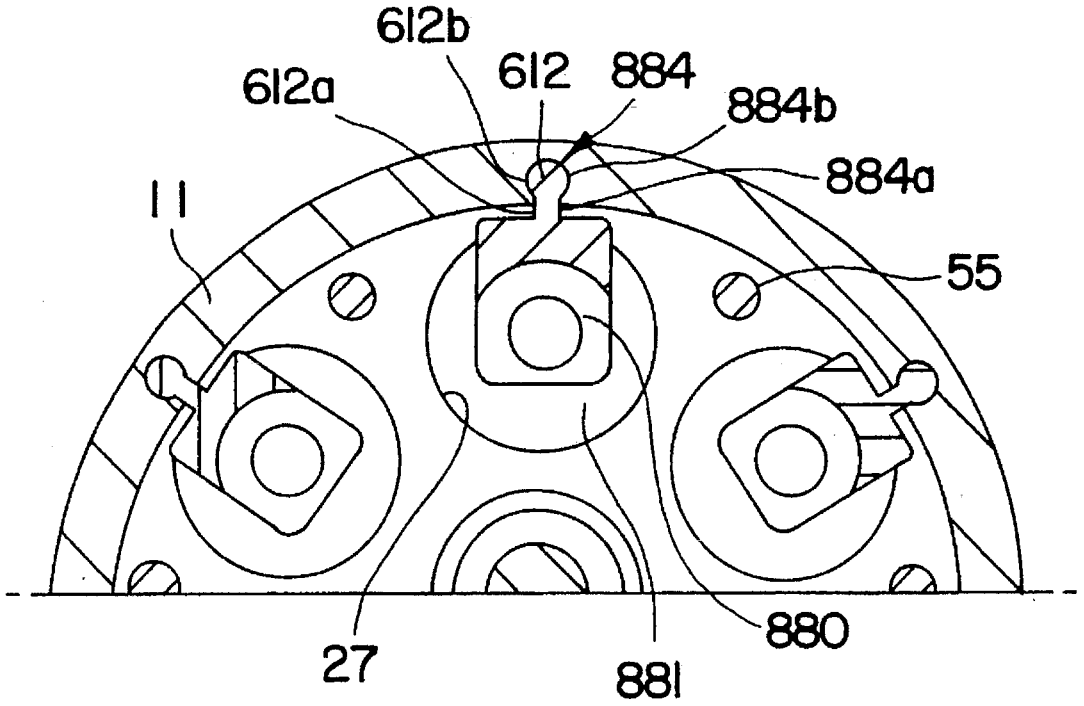
FIG. 13 is a cross-sectional view taken along line 5—5 of FIG. 4 in accordance with a fifth embodiment of the present invention.
Figure 14:
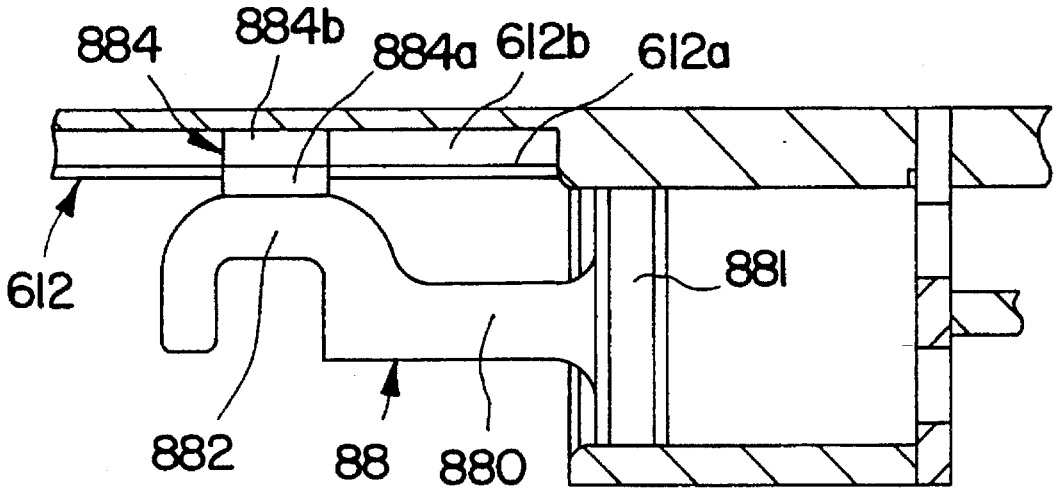
FIG. 14 depicts a guiding mechanism of pistons in accordance with the fifth embodiment of the present invention.

FIGS. 13 and 14 illustrate a fifth embodiment of the present invention, which possesses structures and features similar to those of the first embodiment, with the exception of at least the following structures. Connection portion 882 includes projection 884 extending from the exterior surface thereof and along the longitudinal axis of piston 88. Projection 884 has a keyhole shape in radial cross-section. More particularly, projection 884 includes first portion 884*a* and second portion 884*b* further extending from first portion 884*a*. First projection portion 884*a* and second projection portion 884*b* have a rectangular shaped cross-section and a circular shaped cross-section, respectively. The diameter of second projection portion 884*b* is larger than the width of first projection portion 884*a*.

Compressor housing 11 may include a plurality of grooves 612 formed therein at the positions corresponding to each of cylinders 27 and extending along the longitudinal axis of piston 88. Each of groove 612 may include first groove portions 612*a* and second groove portions 612*b*. Second groove portions 612*b* are designed to extend deeper into the interior of housing 11 than first groove portions 612*a*. First groove portions 612*a* and second groove portions 612*b* also have a rectangular shaped cross-section and a circular shaped cross-section, respectively. The diameter of second groove portion 612*b* is larger than the width of first groove portion 612*a*. Further, each of piston 88 is connected with housing 11, so that projection 884 may smoothly slide in grooves 612 of housing 11.

Each of these embodiments may obtain substantially similar advantages as those described with respect to the first embodiment. Nevertheless, although the present invention has been described in connection with preferred embodiments, the invention is not limited thereto. It will be easily understood by those of ordinary skill in the art that variations and modification may be easily made within the scope of this invention as defined by the following claims.

I claim:

1. A compressor comprising:

a compressor housing including a crank chamber, a suction chamber, a discharge chamber, and a cylinder block;

a plurality of cylinders formed in said cylinder block, each of said cylinders having an inner surface;

a plurality of pistons, each of which is slidably disposed within one of said cylinders, each of said pistons having an end and an axis;

a drive shaft rotatably supported in said cylinder block;

a plate tiltably connected to said drive shaft;

a bearing coupling said plate to said pistons, so that said pistons are driven in a reciprocating motion within said cylinders upon rotation of said plate;

at least one working chamber defined by the end of each of said pistons and the inner surface of each of said cylinders;

a support portion disposed coaxially with said drive shaft and tiltably supporting a central portion of said plate; and a piston guiding mechanism including at least one first guide formed on a peripheral surface of said piston and at least one second guide disposed within said housing, said at least one second guide having a first portion for guiding said at least one first guide to slide smoothly along said at least one second guide so as to prevent said piston from rotating around axis thereof and a second portion radially extending from said first portion for guiding said at least one first guide to slide smoothly along said at least one second guide so as to prevent said piston from radially inclining as said piston reciprocates within said cylinders.

2. The compressor of claim 1, wherein said first guide includes at least one arm radially extending from a peripheral surface of said piston and is parallel to the reciprocating direction of said piston for connecting with said second guide, and said second guide includes at least one groove formed in said compressor housing.

3. The compressor of claim 2, wherein each of said arm of said first guide and said groove of said second guide have a rail shaped cross-section.

4. The compressor of claim 1, wherein said first guide includes at least one groove formed on a peripheral of said piston and is parallel to the reciprocating direction of said piston for connecting with said second guide, and said second guide includes at least one arm extending from said compressor housing.

5. The compressor of claim 4, wherein each of said groove of said first guide and said arm of said second guide have a rail shaped cross-section.

6. The compressor of claim 1, wherein said first guide includes at least one arm radially extending from a peripheral surface of said piston, said arm having a projection portion formed on an edge thereof, and said second guide includes at least one arm formed on said compressor housing, said arm of said second guide having at least one groove formed on an edge thereof and being parallel to the reciprocating direction of said piston for connecting with said first guide.

7. The compressor of claim 6, wherein said projection of said arm of said first guide and said groove of said arm of said second guide have semi-circular shaped radial cross-sections.

8. The compressor of claim 6, wherein said projection of said arm of said first guide and said groove of said arm of said second guide have a rectangular shaped cross-section.

9. A compressor comprising:

a compressor housing including a crank chamber, a suction chamber, a discharge chamber, and a cylinder block;

a plurality of cylinders formed in said cylinder block, each of said cylinders having an inner surface;

a plurality of pistons, each of which is slidably disposed within one of said cylinders, each of said pistons having an end and an axis;

a drive shaft rotatably supported in said cylinder block;

a plate tiltably connected to said drive shaft;

a bearing coupling said plate to said pistons, so that said pistons are driven in a reciprocating motion within said cylinders upon rotation of said plate;

at least one working chamber defined by the end of each of said pistons and the inner surface of each of said cylinders;

a support portion disposed coaxially with said drive shaft and tiltably supporting a central portion of said plate; and a piston guiding mechanism including at least one first guide formed on a peripheral surface of said piston, and at least one second guide disposed within said housing for guiding said at least one first guide to slide smoothly along said at least one second guide so as to prevent said piston from rotating around axis thereof or radially inclining as said piston reciprocates within said cylinders;

wherein said first guide includes at least one arm radially extending from a peripheral surface of said piston, said arm of said first guide having at least one groove formed on an edge thereof and being parallel to the reciprocating direction of said piston for connecting with said second guide, and said second guide includes at least one arm formed on said compressor housing, said arm having a projection portion formed on an edge thereof.

10. The compressor of claim 9, wherein each of said groove of said arm of said second guide and said projection of said arm of said second guide have a rectangular shaped radial cross-section.

11. The compressor of claim 9, wherein said groove of said arm of said first guide and said projection of said arm of said second guide have semi-circular shaped radial cross-sections.

12. The compressor of claim 9, wherein said second guide includes a bar member extending through said crank chamber in said compressor housing.

13. The compressor of claim 12, wherein said bar member is a housing bolt.

14. A compressor comprising:

a compressor housing including a crank chamber, a suction chamber, a discharge chamber, and a cylinder block;

a plurality of cylinders formed in said cylinder block, each of said cylinders having an inner surface;

a drive shaft rotatably supported in said cylinder block;

a plate tiltably connected to said drive shaft;

a bearing coupling said plate to said pistons, so that said pistons are driven in a reciprocating motion within said cylinders upon rotation of said plate;

at least one working chamber defined by the end of each of said pistons and the inner surface of each of said cylinders;

a support portion disposed coaxially with said drive shaft and tiltably supporting a central portion of said plate: and a piston guiding mechanism including at least one first guide formed on a peripheral surface of said piston, and at least one second guide disposed within said housing for guiding said at least one first guide to slide smoothly along said at least one second guide so as to prevent said piston from rotating around axis thereof or radially inclining as said piston reciprocates within said cylinders;

wherein said first guide includes at least one arm radially extending from a peripheral surface of said piston and is parallel to the reciprocating direction of said piston for connecting with said second guide, and said second guide includes at least one groove formed in said compressor housing; and wherein said arm of said first guide and said groove of said second guide have key hole shaped cross-sections.

15. A compressor comprising:

a compressor housing including a crank chamber, a suction chamber, a discharge chamber, and a cylinder block;

a plurality of cylinders formed in said cylinder block, each of said cylinders having an inner surface;

a plurality of pistons, each of which is slidably disposed within one of said cylinders, each of said pistons having an end and an axis;

a drive shaft rotatably supported in said cylinder block;

a plate tiltably connected to said drive shaft;

a bearing coupling said plate to said pistons, so that said pistons are driven in a reciprocating motion within said cylinders upon rotation of said plate;

at least one working chamber defined by the end of each of said pistons and the inner surface of each of said cylinders;

a support portion disposed coaxially with said drive shaft and tiltably supporting a central portion of said plate; and a piston guiding mechanism including at least one first guide formed on a peripheral surface of said piston, and at least one second guide disposed within said housing for guiding said at least one first guide to slide smoothly along said at least one second guide so as to prevent said piston from rotating around axis thereof or radially inclining as said piston reciprocates within said cylinders;

wherein said first guide includes at least one groove formed on a peripheral of said piston and is parallel to the reciprocating direction of said piston for connecting with said second guide, and said second guide includes at least one arm extending from said compressor housing; and wherein each of said groove of said first guide and said arm of said second guide have a key hole shaped cross-section.

* * * * *